US010738474B1

(12) United States Patent
Lawas

(10) Patent No.: US 10,738,474 B1
(45) Date of Patent: Aug. 11, 2020

(54) STACKABLE STEP COMPONENT WITH ADJUSTABLE TREAD INCLINE

(71) Applicant: Hanzel Navarro Lawas, Hayward, CA (US)

(72) Inventor: Hanzel Navarro Lawas, Hayward, CA (US)

( * ) Notice: Subject to any disclaimer, the term of this patent is extended or adjusted under 35 U.S.C. 154(b) by 0 days.

(21) Appl. No.: 16/679,190

(22) Filed: Nov. 9, 2019

Related U.S. Application Data

(63) Continuation of application No. 16/528,858, filed on Aug. 1, 2019.

(60) Provisional application No. 62/722,952, filed on Aug. 26, 2018.

(51) Int. Cl.
*E04F 11/104* (2006.01)
*E04F 11/09* (2006.01)
*E04F 11/04* (2006.01)

(52) U.S. Cl.
CPC ..... *E04F 11/1041* (2013.01); *E04F 11/09* (2013.01); *E04F 11/04* (2013.01)

(58) Field of Classification Search
CPC ... E04F 11/1041; E04F 11/112; E04F 11/108; E04F 11/104; E04F 11/04; E04F 11/09; E04G 27/00
See application file for complete search history.

(56) References Cited

U.S. PATENT DOCUMENTS 505,343 A 9/1893 Austin ..... 182/156
7,162,760 B2 * 1/2007 Schweitzer ..... E04F 11/104 14/69.5
8,522,921 B2 * 9/2013 Stanaland ..... E04F 11/04 182/196
8,540,053 B2 * 9/2013 Stanaland ..... E04F 11/04 182/196
8,960,368 B2 * 2/2015 Stanaland ..... E04F 11/04 182/196
8,985,276 B2 * 3/2015 Stanaland ..... E04F 11/04 182/196
9,644,375 B2 * 5/2017 Stanaland ..... E04F 11/04
9,644,376 B2 * 5/2017 Stanaland ..... E04F 11/04
2012/0080271 A1 4/2012 Stanaland ..... 182/196
2013/0326971 A1 12/2013 Stanaland ..... 52/173.1
(Continued)

FOREIGN PATENT DOCUMENTS

WO WO 89/02506 9/1987

*Primary Examiner* — Andrew J Triggs
(74) *Attorney, Agent, or Firm* — Adibi IP Group, PC; Amir V. Adibi; Andrew C. Palmer

(57) ABSTRACT

A stackable step component with adjustable tread incline includes a step frame having a top edge surface and a bottom edge surface. The top edge surface is substantially level when the bottom edge surface is in contact with an inclined ground surface. The stackable step component also comprises one or more ground penetrating features coupled to the step frame that secure the step frame to the ground surface and an adjustable tread coupled to the top edge surface. The adjustable tread allows adjustment of a tread incline angle. The step component is used to construct a stairway one step at a time without costly design intensive stringers. Each step component includes an adjustable tread so after installing, the tread incline of each step can be set to be level or at a desired angle. A quick and inexpensive outdoor stairway is constructed where each step supports at least three-hundred pounds.

14 Claims, 8 Drawing Sheets

(56) References Cited

U.S. PATENT DOCUMENTS

| | | | | |
|---|---|---|---|---|
| 2015/0167309 | A1 | 6/2015 | Stanaland | 14/69.5 |
| 2015/0167310 | A1 | 6/2015 | Stanaland | 52/183 |
| 2016/0002931 | A1 | 1/2016 | Preston | 52/182 |

* cited by examiner

PERSPECTIVE VIEW

FRONT VIEW

BACK VIEW

LEFT SIDE VIEW

TOP VIEW

TOP VIEW WITHOUT TREAD

BOTTOM VIEW

ASSEMBLY VIEW

2ND ASSEMBLY VIEW

FRONT VIEW

STACKABLE STEP COMPONENT WITH ADJUSTABLE TREAD INCLINE

CROSS-REFERENCE TO RELATED APPLICATIONS

This application is a continuation of, and claims the benefit under 35 U.S.C. § 120 from, nonprovisional U.S. patent application Ser. No. 16/528,858, entitled "Stackable Step Component With Adjustable Tread Incline," filed on Aug. 1, 2019. U.S. patent application Ser. No. 16/528,858 claims the benefit under 35 U.S.C. § 119 of U.S. provisional patent application Ser. No. 62/722,952, entitled "Stackable Step Component With Adjustable Tread Incline," filed on Aug. 26, 2018. The subject matter of each of the foregoing documents is expressly incorporated herein by reference.

TECHNICAL FIELD

The described embodiments relate to a stackable step component with adjustable tread incline.

BACKGROUND INFORMATION

A stairway is an architectural construction designed to bridge a large vertical distance by dividing it into smaller vertical distances, called steps. For example, a stairway having many steps is used to allow people to easily walk between the floors of a building. Sometimes a stairway is constructed outdoors to allow people to ascend or descend various levels of a local terrain.

A stringer is a structural member that supports the treads and risers in a standard stairway. There are typically three stringers used; one on either side of the stairway and one in the center, with more added as necessary for wider spans. Typically, the stringers extend for the entire length of the stairway and are carefully installed to support the entire weight of the stairway and the people on the stairway. The stringers also determine the angle or level of the treads. Thus, installing stairway stringers requires planning and potentially costly construction depending on the length of the stairway.

Stringer design and installation may be even more complicated and expensive for outdoor stairways. One reason for this is that the outdoor stairway may be longer, and the grade or incline of the terrain may change over the length of the stairway. In this case, additional excavation and structural supports may be necessary. Thus, given the dimensions of the stairway, changing slope or incline of the terrain, and composition of the terrain, an outdoor stairway may be expensive and difficult to construct.

Therefore, it would be desirable to have a way to construct an outdoor stairway that is easier to design and less expensive to install when compared with typical stairways.

SUMMARY

In various exemplary embodiments, a lightweight, portable, and stackable step component with adjustable tread incline is disclosed.

A stackable step component comprises a step frame having a top region and a contoured bottom region. The top region is substantially level when the bottom region is in contact with an inclined ground surface or terrain. The stackable step component also comprises one or more ground penetrating features coupled to the step frame that stabilized the step frame on the inclined ground surface when the one or more ground penetrating features penetrate the ground surface. The stackable step component also comprises an adjustable tread coupled to the top region. The adjustable tread allows adjustment of a tread incline angle. The stackable component supports at least three hundred pounds when stabilized on the inclined ground surface.

In one embodiment, a stackable step component is provided that includes a step frame having a top edge surface and a bottom edge surface. The top edge surface is substantially level when the bottom edge surface is in contact with an inclined ground surface. The stackable step component also comprises one or more ground penetrating features coupled to the step frame that secure the step frame to the ground surface, and an adjustable tread coupled to the top edge surface. The adjustable tread allows adjustment of a tread incline angle.

In another embodiment, a method is provided for forming an adjustable step. The method includes forming a step frame. Next, an adjustable tread is attached to the step frame. Next, an adjustment feature that adjusts a tread plane of the adjustable tread is attached. Next, stops or rails are attached to the step frame.

The foregoing is a summary and thus contains, by necessity, simplifications, generalizations and omissions of detail; consequently it is appreciated that the summary is illustrative only. Still other methods, and structures and details are set forth in the detailed description below. This summary does not purport to define the invention. The invention is defined by the claims.

BRIEF DESCRIPTION OF THE DRAWINGS

The accompanying drawings, where like numerals indicate like components, illustrate embodiments of the invention.

DETAILED DESCRIPTION

In various exemplary embodiments, a lightweight, portable, and stackable step component with adjustable tread incline is disclosed. The step component can be used to construct an entire stairway one step at a time without the need of costly and design intensive stringers. Each step component includes an adjustable tread so that once installed, the tread incline of each step can be set to be level or at a desired angle. Thus, multiple step components can be used to quickly and inexpensively construct an outdoor stairway while avoiding the time and expense of traditional stairway construction. Reference will now be made in detail to some exemplary embodiments of the step component, examples of which are illustrated in the accompanying drawings.

Figure 1:
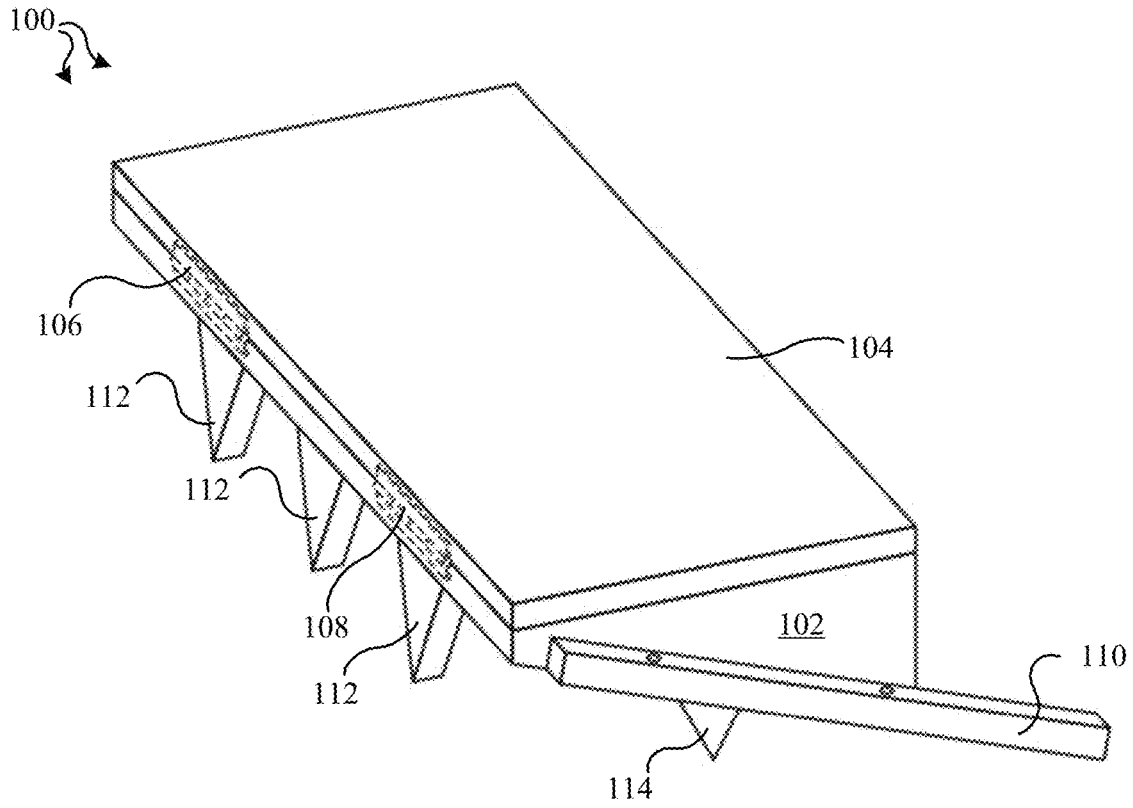
FIG. 1 shows a perspective view of an exemplary embodiment of a stackable step component.

FIG. 1 shows a perspective view of an exemplary embodiment of a stackable step component 100. The step component 100 comprises a left side frame component 102, tread 104, right hinge 106, left hinge 108, left stop 110, back ground penetrating features 112, and a left side ground penetrating feature 114. The hinges 106 and 108 allow adjustment of an angle between a top edge of the side frame component 102 and the tread 104. The step component 100 also includes a right side frame component not shown in FIG. 1. In various exemplary embodiments, the stackable step component 100 can be made of wood, metal, or plastic, such as acrylonitrile butadiene styrene (ABS) plastic, polycarbonate plastic, or a mix/blend of ABS and polycarbonate plastic.

Figure 2:
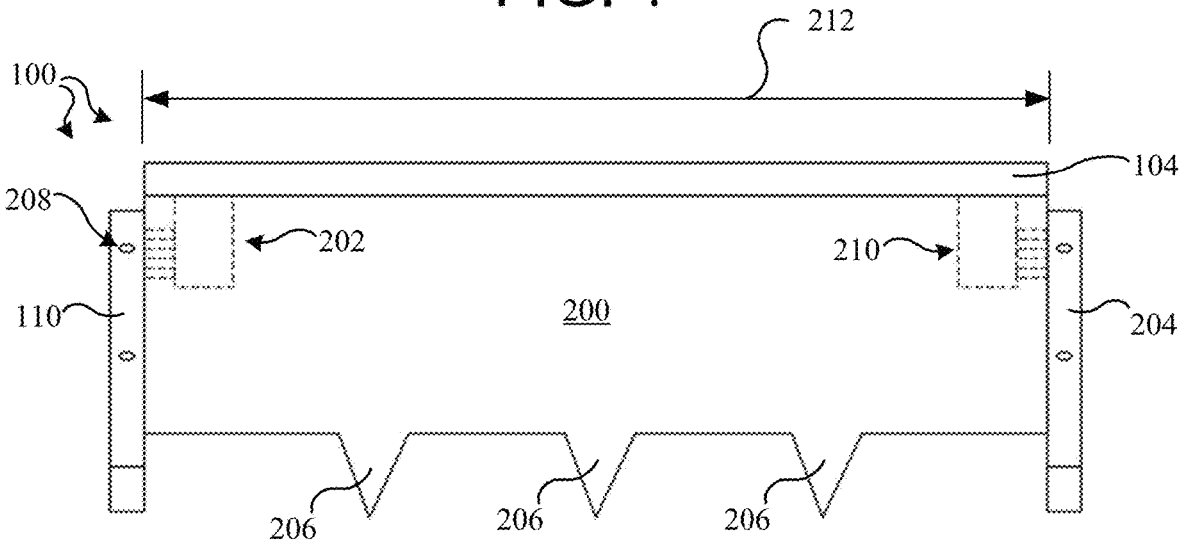
FIG. 2 shows a front view of the stackable step component shown in FIG. 1.

FIG. 2 shows a front view of the stackable step component 100 shown in FIG. 1. This front view shows a front frame component (riser) 200, left stop 110, right stop 204, and front ground penetrating features 206. Also shown are dashed lines representing a left tread adjustment feature 202 and a right tread adjustment feature 210 that are located behind the riser 200. The left 110 and right 204 stops include openings or holes, such as opening 208 to allow a pin, rod, or other object to pass through the stops and penetrate the ground surface when the step is placed on the ground. The stops 110 and 204 secure the step to the ground and prevent the step from sinking in the ground. In an exemplary embodiment, the width 212 of the step 100 is approximately 24.0 inches.

Figure 3:
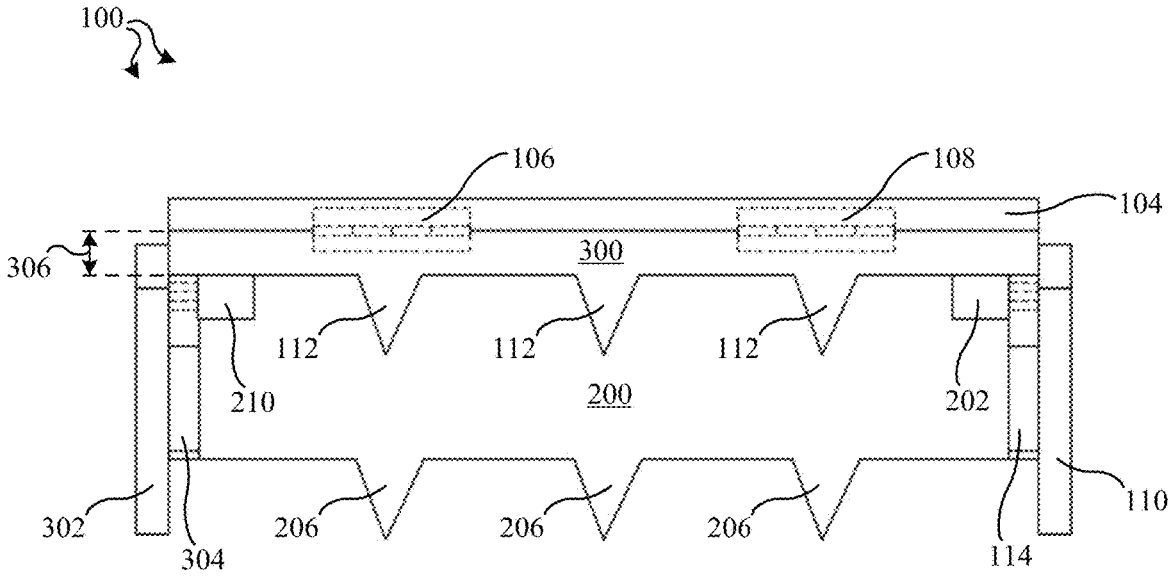
FIG. 3 shows a back view of the stackable step component shown in FIG. 1.

FIG. 3 shows a back view of the stackable step component 100 shown in FIG. 1. This back view shows hinges 106 and 108, left stop 110, left ground penetrating feature 114, tread 104, and a back view of the riser 200. Also shown are back frame component 300, right ground penetrating feature 304, left adjustment block 202, right adjustment block 210, and right stop 302. The left 202 and right 210 adjustment blocks are used to adjust an angle formed between the tread 104 and the frame components. In an exemplary embodiment, the back frame component 300 has a height 306 of approximately 1.5 inches.

Figure 4:
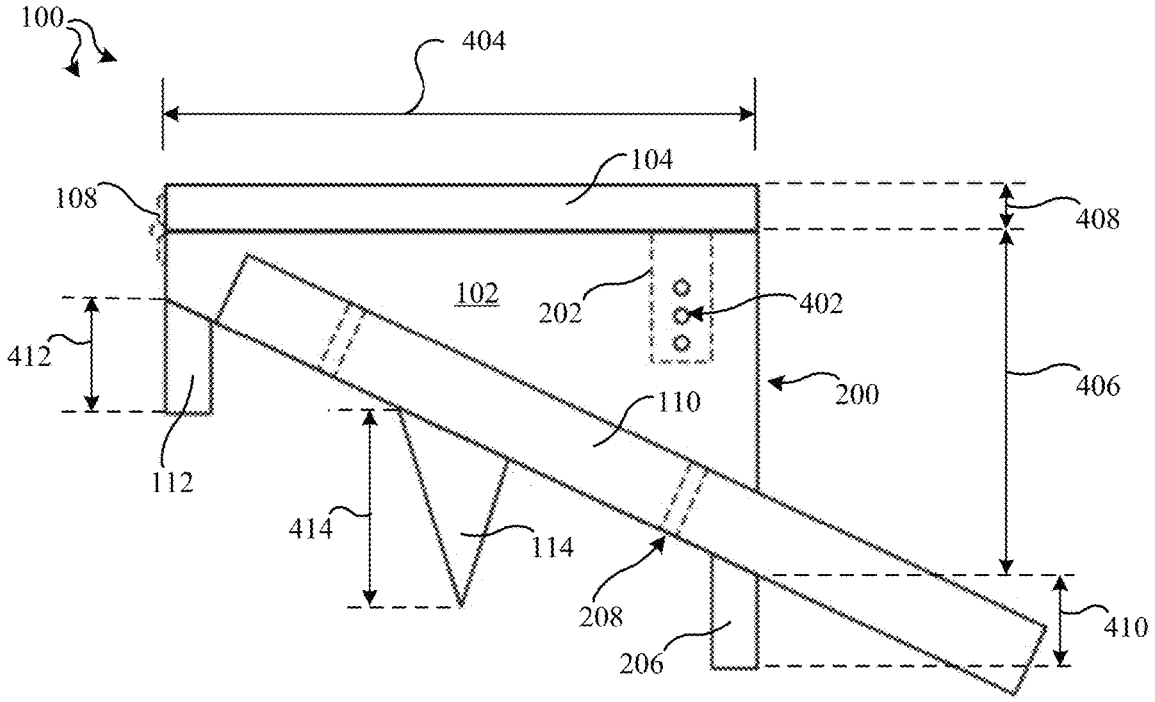
FIG. 4 shows a left side view of the stackable step component shown in FIG. 1.

FIG. 4 shows a left side view of the stackable step component 100 shown in FIG. 1. This left side view shows the left frame component 102, left stop 110, left ground penetrating feature 114, back ground penetrating feature 112, front ground penetrating feature 206, hinge 108, and tread 104. Also shown are stop openings (e.g., 208) through the left stop 110. Behind the left frame component 102 can be seen the left block 202. In alignment with the left block 202 are adjustment openings 402 that allow a pin or rod to pass through the left frame component 102 and set an angle between the tread 104 and a top edge of the frame component 102.

In an exemplary embodiment, the tread 104 has a depth 404 of approximately 10.0 inches and a thickness 408 of approximately 1.00 inch. The riser 200 has a height 406 of approximately 6.5 inches and the front ground penetrating feature 206 has a height 410 of approximately 3.0 inches. The back ground penetrating feature has a height 412 of approximately 3.0 inches and the left side ground penetrating feature 114 has a height 414 of approximately 4.0 inches.

Figure 5:
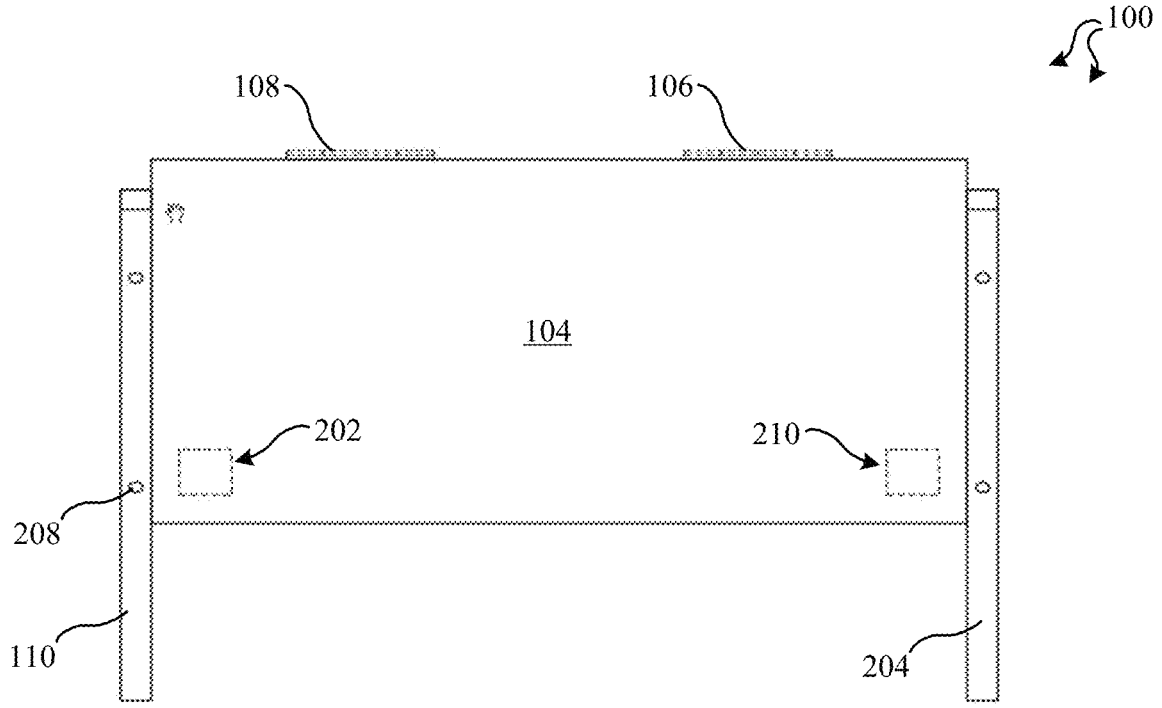
FIG. 5 shows a top view of the stackable step component shown in FIG. 1.

FIG. 5 shows a top view of the stackable step component 100 shown in FIG. 1. This top view shows a top surface of the tread 104, left stop 110, right stop 204, and stop openings 208. Also shown are left adjustment block 202 and right adjustment block 210, which are shown by dashed lines to indicate their positions underneath the tread 104.

Figure 6:
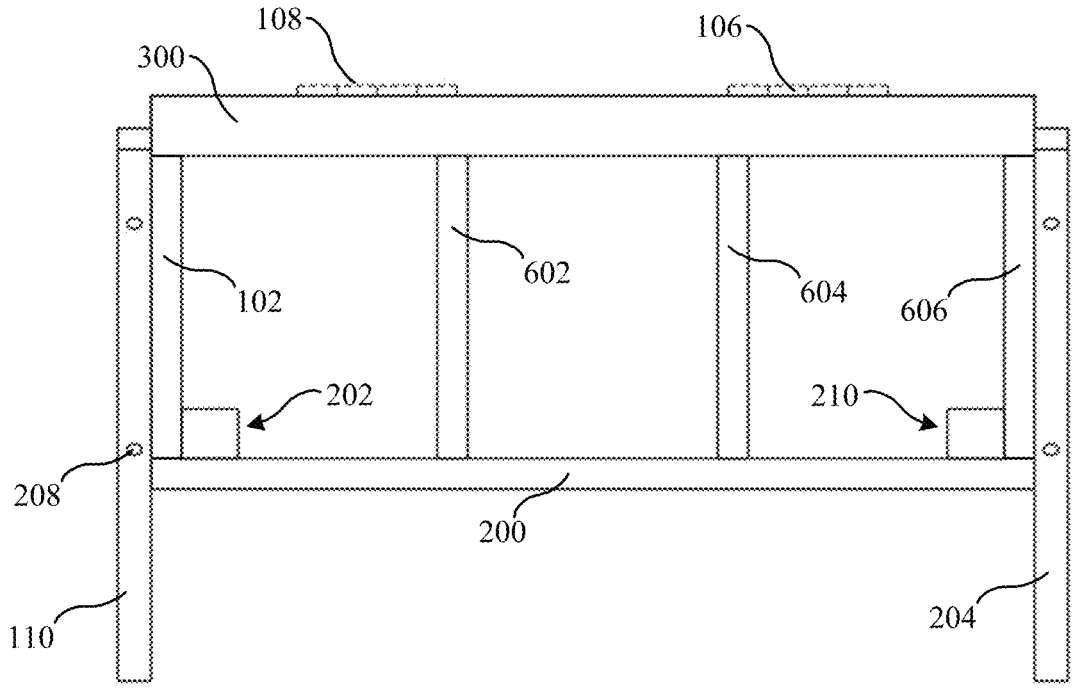
FIG. 6 shows a top view (without the tread) of the stackable step component shown in FIG. 1.

FIG. 6 shows a top view (without tread 104) of the stackable step component 100 shown in FIG. 1. This top view shows all the components identified in FIG. 5. This top view also shows top edge surfaces of the riser 200, the back frame component 300, the left frame component 102, and a right frame component 606. Also shown are left interior frame component 602 and right interior frame component 604.

Figure 7:
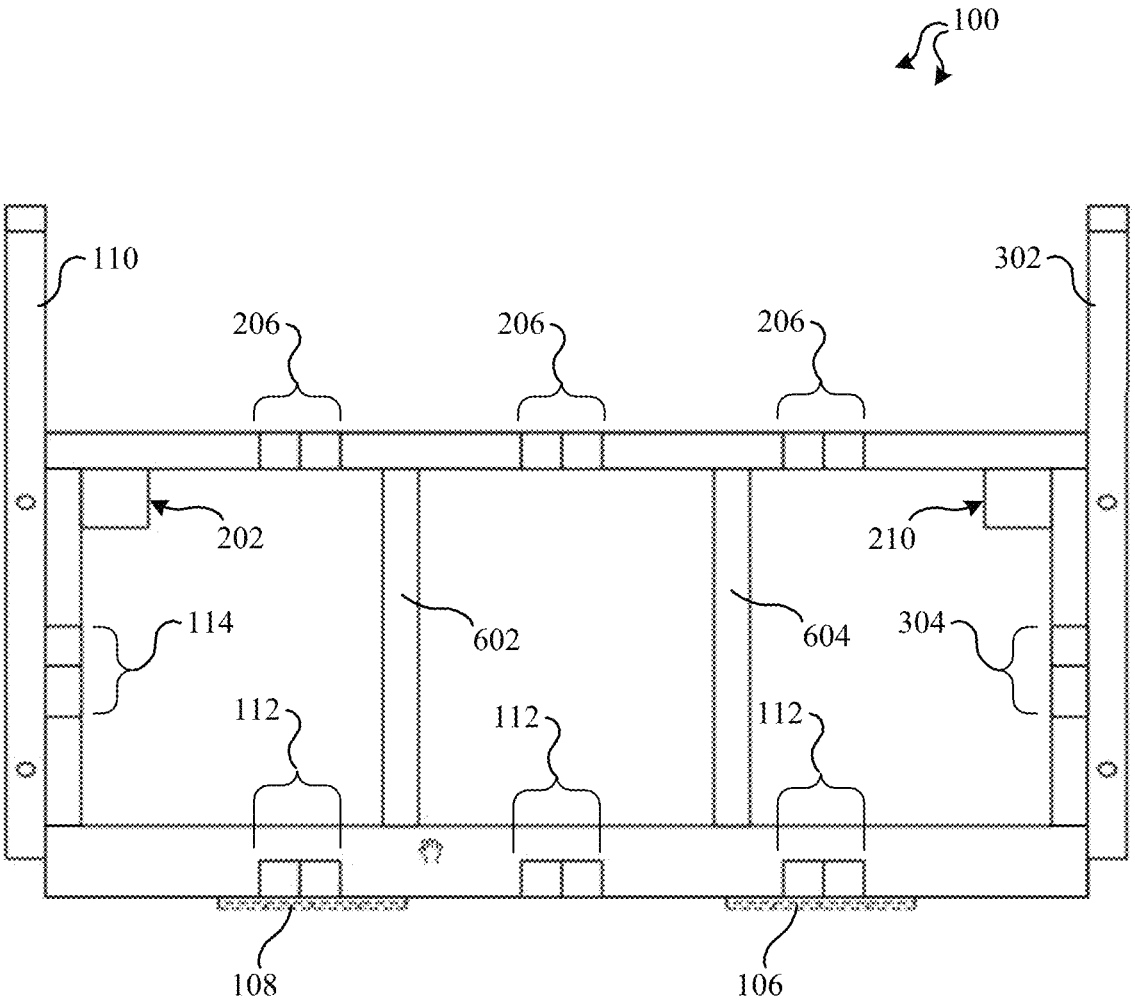
FIG. 7 shows a bottom view of the stackable step component shown in FIG. 1.

FIG. 7 shows a bottom view of the stackable step component 100 shown in FIG. 1. This bottom view shows the locations of the front ground penetrating features 206, the back ground penetrating features 112, the left ground penetrating feature 114, and the right ground penetrating feature 304.

Figure 8:
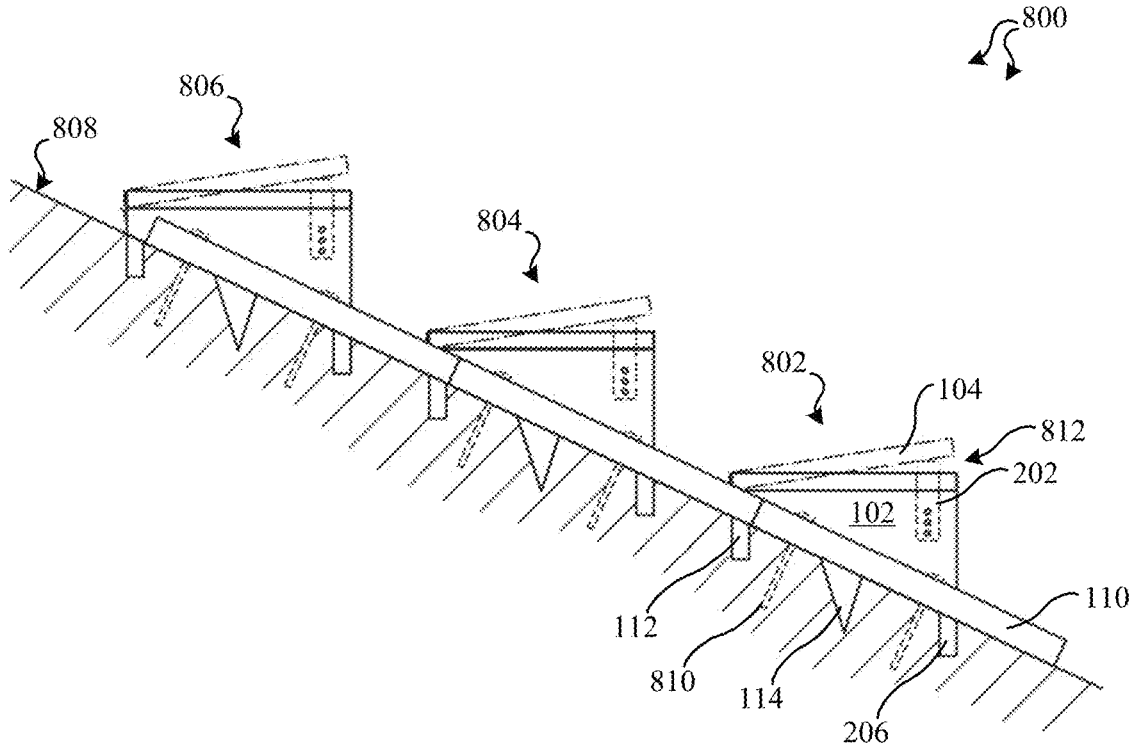
FIG. 8 shows an assembly view of multiple stackable step components.

FIG. 8 shows a side view 800 of an assembly of multiple stackable step components. This side view shows step components 802, 804 and 806 positioned on an exterior inclined terrain 808 to form a short exterior staircase.

Details of step component 802 apply equally to step components 804 and 806. The step component 802 illustrates how front 206, left side 114, and back 112 ground penetrating features penetrate the terrain 808 when the steps are installed. The step 802 also illustrates how pins 810 are passed through the openings 208 in the left stop 110 to further secure the step 802 to the terrain 808. As illustrates at 810, the adjustment block 202 is used to change an angle 812 the tread 104 makes with the top edge of the left frame component 102 so that the step can be leveled with respect to the terrain 808. In an exemplary embodiment, the angle 812 is adjustable from 0 to 40 degrees.

Figure 9:
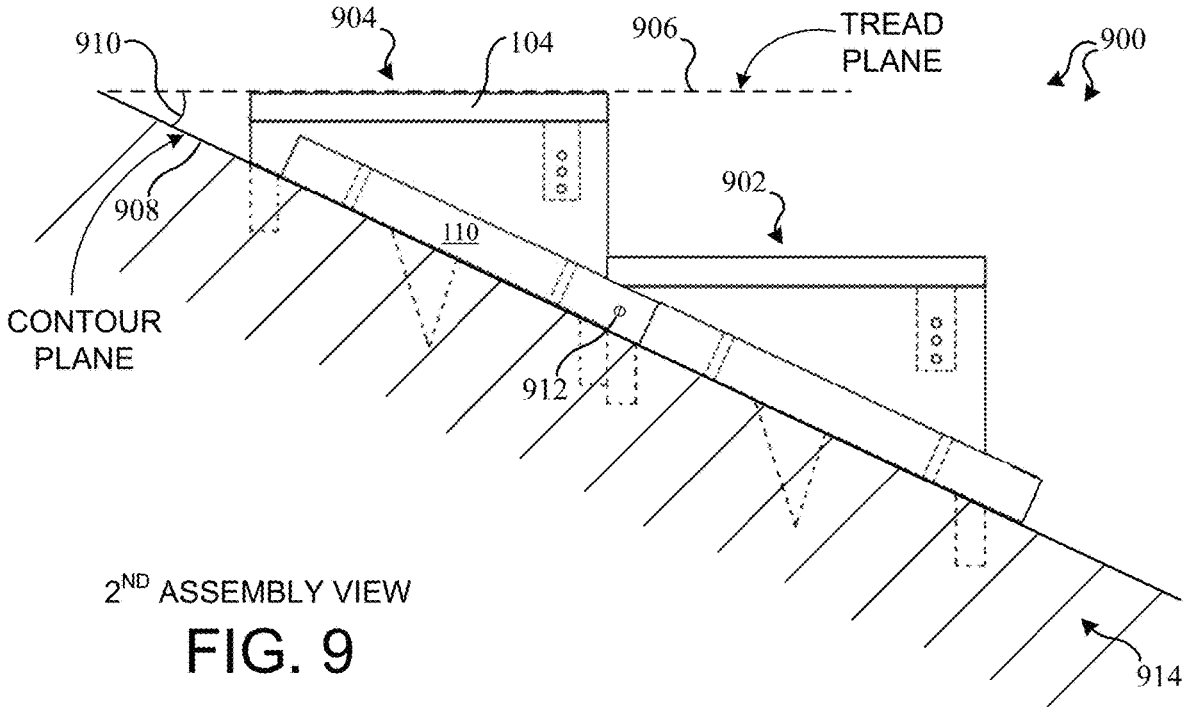
FIG. 9 shows another assembly view of multiple stackable step components.

FIG. 9 shows a side view 900 of an assembly of multiple stackable step components. This side view shows step components 902 and 904 positioned on an exterior terrain 914 to form a short exterior staircase.

This embodiment illustrates how step 904 can be positioned adjacent to step 902 to form a continuous stairway. The left stop 110 of step 904 is attached to the frame of step 902 using screw attachment 912. This provides additional support for the final stairway.

A tread plane 906 is defined that passes along the top surface of the tread 104 of step 904. A contour plane 908 also is defined which passes along the bottom edges of the steps and follows the contour of the terrain 914. The contour plane 908 and the tread plane 906 form an angle 910. For a given terrain, the angel 910 indicates how the tread 104 and tread plane 906 should be adjusted relative to the contour plane 908 so that the tread plane 906 is level when the step is installed on the terrain.

Figure 10A:
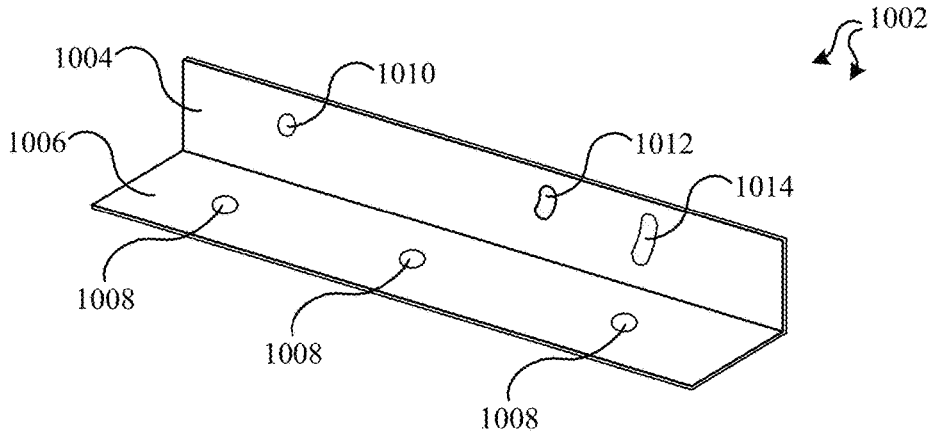
FIG. 10A shows an embodiment of a mounting rail for use in an alternative embodiment of a stackable step component

FIG. 10A shows an embodiment of a mounting rail 1002 for use in an alternative embodiment of a stackable step component. For example, in an embodiment, two rails 1002 replace the left 110 and right 204 stops. The rail 1002 includes a right-angle bend that forms a step mounting portion 1004 and a surface mounting portion 1006. The surface mounting portion 1006 includes holes 1008 or openings that accept mounting spikes or pins. The step mounting portion 1004 includes a pivot hole 1010 or opening that accepts a bolt or fastener. The step mounting portion 1004 also includes first 1012 and second 1014 adjustment slots that accept bolts or fasteners. The pivot hole 1010 and slots 1012, 1014 provide for adjustment when securing the mounting rail 1002 to the step, thereby adjusting the step for use with varying terrains.

In an embodiment, the rails are adjustable to match the slope or incline of the terrain, for example, for inclines in the range of 20-35 degrees. In addition, the rail on each side of the step is independent, such that the rail on one side could be set to 25 degrees and the rail on the other side of the step could be set 28 degrees.

Figure 10B:
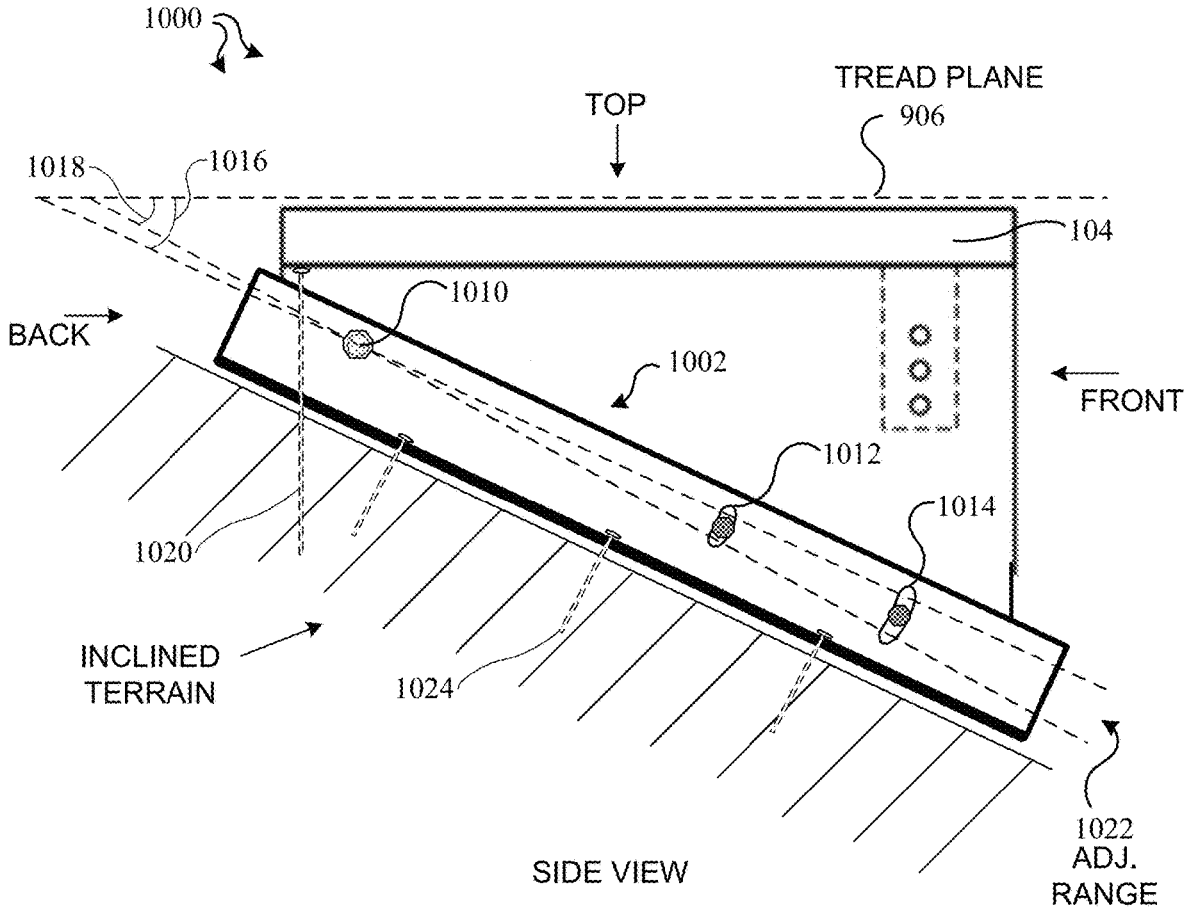
FIG. 10B shows a side view of a step illustrating how the mounting rail 1002 mounts to the step.

FIG. 10B shows a side view of a step 1000 illustrating how the mounting rail 1002 mounts to the step. A bolt through the pivot hole 1010 secures the mounting rail 1002 to the back portion of the step 1000. Two additional bolts are inserted into the slots 1012, 1014 to secure the mounting rail 1002 near the front portion of the step 1000. The slots provide a range of adjustment 1022 that allows the bottom surface of the mounting rail 1002 to be adjusted with respect to the tread plane 906 of the top surface of the top 104. For example, angle indicators 1016 and 1018 indicate the minimum and maximum adjustment to the angle between the bottom surface of the mounting rail 1002 and the tread plane 906 of the top surface. Thus, depending on the terrain on which the step 1000 is mounted, the mounting rail 1002 can be adjusted so that the tread plane 906 of the top surface of the top 104 is level.

FIG. 10B also illustrates rear mounting nail or spike 1020 that passes through the back frame component 300 and into the terrain to secure the back of the step. In an embodiment, two or three rear mounting nails are used. In addition, side mounting nails 1024 are user to secure the rails 1002 to the terrain. In an embodiment, three side mounting nails are used per rail.

Figure 11:
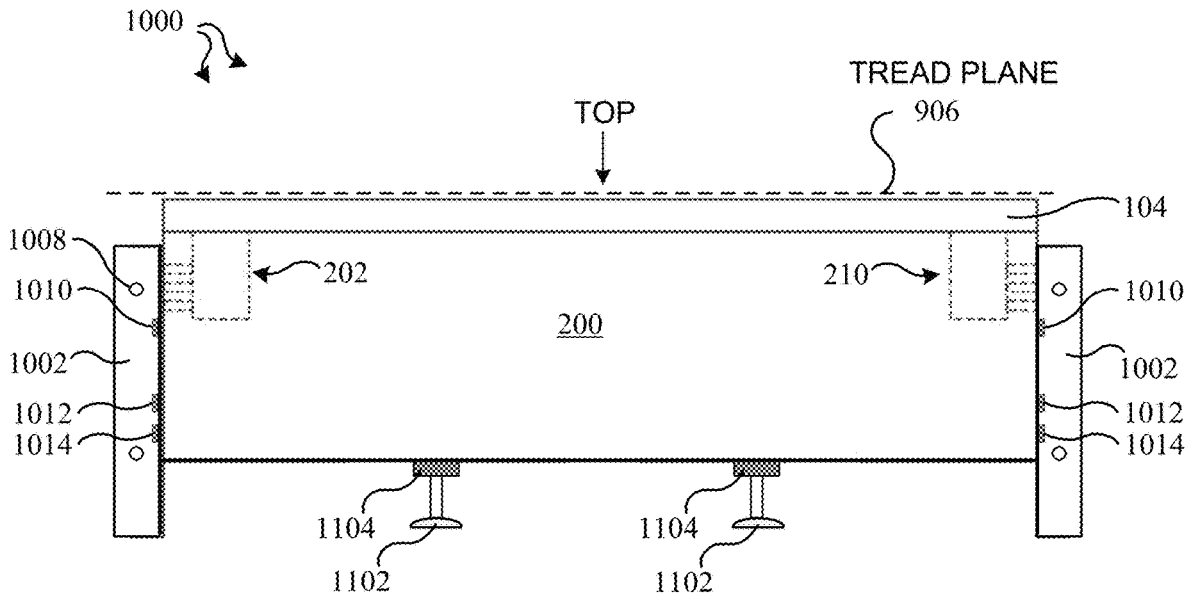
FIG. 11 shows a front view of the stackable step component shown in FIG. 10B.

FIG. 11 shows a front view of the stackable step component 1000 shown in FIG. 10B. As illustrated in FIG. 11, the mounting rails 1002 are mounted to the left and right sides of the step 1000. The holes 1008 in the mounting rails allow the step 1000 to be secured to the terrain using spikes, pins or other ground penetrating features or devices. Each rail is secured to the step by a bolt through the pivot hole 1010. The rails 1002 are then adjusted to the appropriate angle for the terrain, and then bolts through the slots 1012, 1014 secure the rails to the step at the desired angle. When installed, the adjustment of the rails 1002 levels the tread plane 906 of the top surface. It should be noted that the left and right rails 1002 can be adjust to have different angles with respect to the tread plane 906 so that the top 104 can be leveled from front to back and side to side.

The step 1000 also includes adjustable support feet 1102. For example, in this embodiment, the ground penetrating features 206 are replaced by the adjustable support feet 1102. The support feet 1102 are adjusted by rotating an adjustment dial 1104 to adjust the height of the support feet 1102 so that they rest on or dig into the terrain when the step is installed. This provides additional support for the step 1000.

It be noted that the dimensions provided above are exemplary and that larger or smaller dimensions may be utilized. Other embodiments are suitable for use with a range of dimensions such that the size and shape of the step and/or its components are completely flexible.

Figure 12:
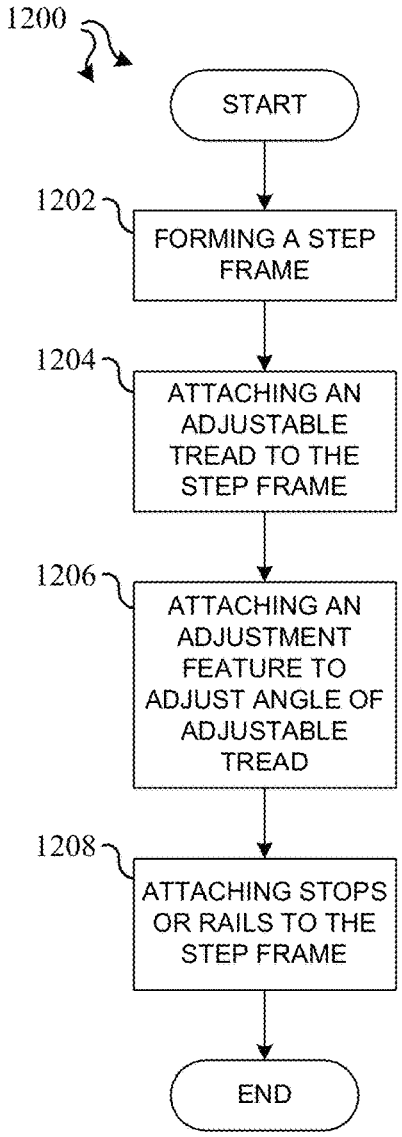
FIG. 12 shows a method for forming an adjustable step in accordance with the present invention.

FIG. 12 shows a method 1200 for forming an adjustable step in accordance with the present invention. For example, the method 1200 operates to form the steps as illustrated and described above.

At block 1202, a step frame is formed. For example, the step from comprise front frame component 200, left side component 102, right side component 606, and back frame component 300. The components of the frame form a top frame edge that supports the tread 104, and a bottom edge that rest against the terrain when the step is installed.

At block 1204, an adjustable tread is attached to the step frame. For example, the tread 104 is attached to the step frame using hinges 106, and 108.

At block 1206, an adjustment feature is attached that adjusts the adjustable tread. For example, the adjustment blocks 202 and 210 are mounted to the underside of the tread 104, and adjustment openings or holes 402 are made in the left 102 and right 606 side components. The holes 402 accept pins that adjust the angle 812 the tread makes with the top edge of the frame. In an embodiment, there are three holes 402 that allow the angle to be adjusted from 0-40 degrees.

At block 1208, stops or rails are attached to the step frame. For example, in one embodiment, stops 110, 204 are attached to the left 102 and right 606 side components. In another embodiment, rails 1002 are attached to the left 102 and right 606 side components.

It should be noted that the method 1200 is exemplary and that changes, additions, rearrangements, deletions, and/or modifications of the operations are within the scope of the exemplary embodiments.

Figure 13:
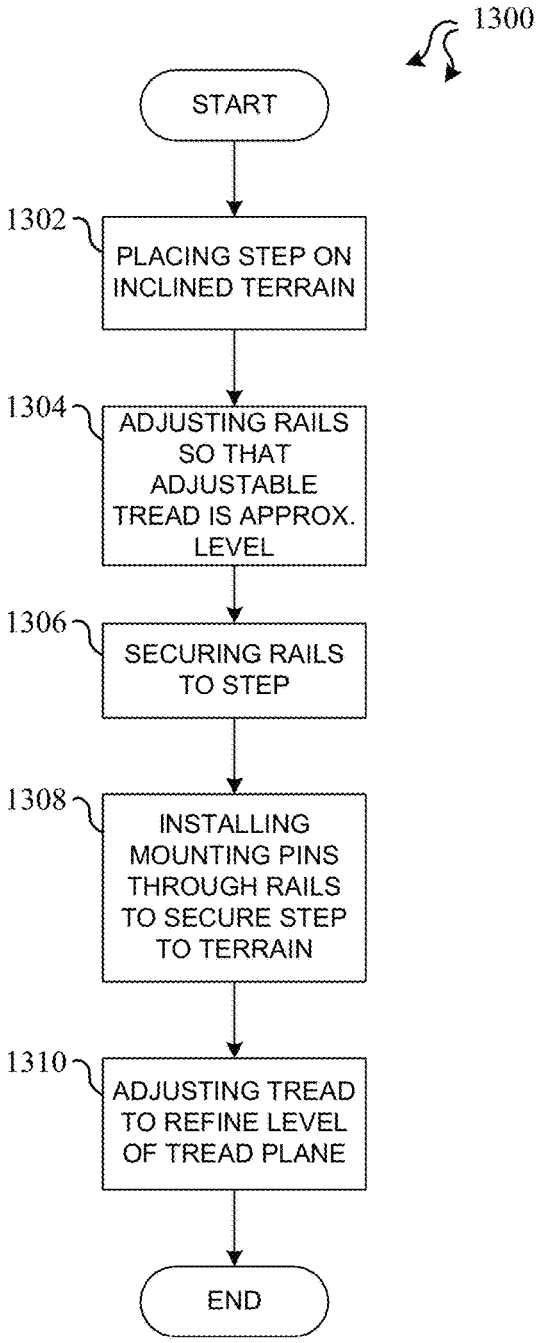
FIG. 13 shows a method for installing an adjustable step in accordance with the present invention.

FIG. 13 shows a method 1300 for installing an adjustable step in accordance with the present invention. For example, the method 1300 operates to install an adjust step as illustrated and described herein.

At block 1302, a step is placed on an inclined terrain. For example, the step 802 is placed on the inclined terrain 808.

At block 1304, rails of the step are adjusted so that an adjustable tread of the step is approximately level. For example, as illustrated in FIG. 10B, the rails 1002 of the step are adjusted using the slots 1012, 1014 so that the tread plane 906 is approximately level.

At block 1306, the rails are secured to the step. For example, fasteners, such as bolts, are placed through the slots 1012, 1014 and tightened so that the rail 1002 is secured to the step 1000 while maintaining the adjusted position determined at block 1304.

At block 1308, mounting pins are inserted to secure the step to the terrain. For example, pins, spikes or other ground penetrating features are placed through the holes 1008 to secure the step to the terrain.

At block 1310, the adjustable tread is adjusted to refine the level of the tread plane. For example, the adjustment tread is further adjusted as described above to obtain the most level surface for the tread 104.

It should be noted that the method 1300 is exemplary and that changes, additions, rearrangements, deletions, and/or modifications of the operations are within the scope of the exemplary embodiments.

In another embodiment, the stackable step is installed by a user by placing the step at the desired location on the inclined terrain and nailing two front spikes part way into the terrain to hold the step in place. A level is used to level the tread plane of the step from side-to-side and front-to-back. Next, six bolts (three per side) are lightly tighten to secure the position of the rails to the step. Then, four spikes (two per side) are nailed into the terrain to secure the rails to the terrain. The two front spikes are then nailed all the way into the terrain. The two height-adjustable leg supports are adjusted until both rear leg supports touch the ground.

Finally, the six bolts that secure the rails to the step are completely tightened to complete the installation.

Although certain specific exemplary embodiments are described above in order to illustrate the invention, the invention is not limited to the specific embodiments. Accordingly, various modifications, adaptations, and combinations of various features of the described embodiments can be practiced without departing from the scope of the invention as set forth in the claims.

What is claimed is:

1. An apparatus, comprising:

a step frame having a top edge surface and a bottom edge surface, wherein the top edge surface is substantially level when the bottom edge surface is in contact with a ground surface having an incline angle within a selected range;

one or more ground penetrating features coupled to the step frame that secure the step frame to the ground surface;

an adjustable tread coupled to the top edge surface, wherein the adjustable tread allows adjustment of a tread incline angle; and left and right side rails mounted to the step frame, wherein each side rail includes a surface mounting portion that includes one or more holes to accept the one or more ground penetrating features.

2. The apparatus of claim 1, wherein the step frame comprises a front portion, left and right side portions, and a back portion.

3. The apparatus of claim 2, wherein each of the front portion, left and right side portions, and back portion are formed from a material selected from a set comprising wood, metal, and plastic.

4. The apparatus of claim 1, wherein the one or more ground penetrating features comprise wood or metal protrusions that extend from the bottom edge surface.

5. The apparatus of claim 1, wherein the one or more ground penetrating features are removable from the step frame.

6. The apparatus of claim 1, further comprising at least one hinge that connects the adjustable tread to the top edge surface.

7. The apparatus of claim 6, wherein the at least one hinge extends along one dimension of the adjustable tread.

8. The apparatus of claim 1, further comprising an adjustment feature formed on the step frame to adjust an incline angle of the adjustable tread.

9. The apparatus of claim 1, further comprising one or more stops coupled to the step frame that receive the one or more ground penetrating features.

10. The apparatus of claim 9, wherein the one or more stops interlock multiple step frames together to form a stairway.

11. The apparatus of claim 1, wherein each side rail includes a step mounting portion that includes a pivot hole and one or more slots to mount each side rail to the step frame, and wherein the one or more slots allow adjustment of the side rails to adjust an angle between the mounting surface portion of the side rail and a tread plane of the adjustable tread.

12. A method for forming an adjustable step, comprising:

forming a step frame, wherein the operation of forming the step frame comprises forming the step frame to have front, back, left, and right frame components;

attaching an adjustable tread to the step frame;

attaching an adjustment feature that adjusts a tread plane of the adjustable tread; and attaching one of stops or rails to the step frame, wherein the operation of attaching one of stops or rails comprises attaching rails to the step frame, wherein a first rail is attached to the left frame component and a second rail is attached to the right frame component, and wherein each rail includes a surface mounting portion that includes one or more holes that accept ground penetrating features.

13. The method of claim 12, wherein the operation of attaching the adjustable tread comprises attaching the adjustable tread to the step frame using at least one hinge.

14. The method of claim 12, wherein the operation of attaching rails comprises attaching each rail by inserting a fastener through a pivot hole and at least one slot.

* * * * *